US007641451B2

(12) United States Patent
Lee

(10) Patent No.: US 7,641,451 B2
(45) Date of Patent: Jan. 5, 2010

(54) TURBO PUMP AND PROCESSING APPARATUS COMPRISING THE SAME

(75) Inventor: Sung-Il Lee, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 815 days.

(21) Appl. No.: 11/193,328

(22) Filed: Aug. 1, 2005

(65) Prior Publication Data

US 2006/0034713 A1 Feb. 16, 2006

(30) Foreign Application Priority Data

Aug. 16, 2004 (KR) ..... 10 2004 0064274

(51) Int. Cl.
*F04B 49/02* (2006.01)
*F04B 17/00* (2006.01)

(52) U.S. Cl. ..... 417/423.4; 417/423.1; 417/423.7; 415/90; 416/3

(58) Field of Classification Search ..... 417/423.1, 417/423.4, 423.7, 322; 416/3; 415/90
See application file for complete search history.

(56) References Cited

U.S. PATENT DOCUMENTS 4,023,920 A * 5/1977 Bachler et al. ..... 417/354
4,111,595 A * 9/1978 Becker et al. ..... 415/90
4,502,832 A * 3/1985 Becker ..... 415/10
4,579,508 A * 4/1986 Tsumaki et al. ..... 415/229
5,106,273 A * 4/1992 Lemarquand et al. ..... 417/354
5,547,338 A * 8/1996 Conrad et al. ..... 415/90
5,652,473 A * 7/1997 Delamare et al. ..... 310/90.5
5,667,363 A * 9/1997 Bernhardt et al. ..... 417/44.1
5,961,291 A * 10/1999 Sakagami et al. ..... 417/42
6,332,752 B2 * 12/2001 Ikegami et al. ..... 415/90
6,416,290 B1 * 7/2002 Yamauchi ..... 417/32
6,508,631 B1 * 1/2003 Smith et al. ..... 417/44.2
6,638,010 B2 * 10/2003 Conrad et al. ..... 415/90
6,644,938 B2 * 11/2003 Omori ..... 417/353
6,736,593 B2 5/2004 Namiki et al.
6,736,614 B1 5/2004 Bahnen et al.
6,832,888 B2 * 12/2004 Kabasawa et al. ..... 415/90
2001/0018018 A1 * 8/2001 Conrad et al. ..... 415/90
2003/0077187 A1 * 4/2003 Kabasawa et al. ..... 417/322
2003/0170132 A1 * 9/2003 Englander et al. ..... 417/423.4
2007/0031270 A1 * 2/2007 Maejima et al. ..... 417/423.4

* cited by examiner

*Primary Examiner*—Devon C Kramer
*Assistant Examiner*—Leonard J Weinstein
(74) *Attorney, Agent, or Firm*—Volentine & Whitt, PLLC

(57) ABSTRACT

A turbo pump for evacuating a process chamber minimizes the amount time necessary to reduce the speed of the rotor in preparation for performing maintenance in the process chamber or the like. The turbo pump includes a housing communicating with the reaction chamber, a plurality of fixed stator rings spaced from one another along an inner peripheral surface of the housing, a shaft supported for rotation in the housing, a stator base surrounding the shaft and having an electric coil, a plurality of rotor blades each extending between an adjacent pair of the stator rings, and an electrode disposed at an outer peripheral surface of the housing. The electrode can receive an electric charge opposite to that applied to the rotor to forcibly stop the rotation of the rotor. Also, an electrical contact can be conductively connected to the rotor. Thus, opposite charges can be applied to the blades of the rotor and the stator to prevent the blades from contacting the stator when, for example, air backflows into the housing through a discharge port.

20 Claims, 4 Drawing Sheets

TURBO PUMP AND PROCESSING APPARATUS COMPRISING THE SAME

BACKGROUND OF THE INVENTION

1. Field of the Invention

The present invention generally relates to an apparatus for manufacturing a semiconductor device. More particularly, the present invention relates to a turbo pump used to pump air or reaction gas from a reaction chamber in which a semiconductor manufacturing process takes place.

2. Description of the Related Art

Semiconductor devices are manufactured using various apparatuses to perform several different types of processes on a wafer. Generally, the apparatuses used to manufacture semiconductor devices include an ion implantation apparatus that implants impurity ions into a semiconductor wafer, a deposition apparatus that forms a thin film on the semiconductor wafer, and an etching apparatus that etches the thin film. The deposition and the etching apparatuses have closed reaction chambers in order to protect the semiconductor wafer from contaminants in the ambient surrounding the chambers. Also, air is continuously pumped into the process chambers to maintain a high vacuum state or a low vacuum state during a manufacturing process.

FIG. 1 is a schematic cross-sectional view of a conventional semiconductor device manufacturing apparatus. The apparatus generally includes a reaction chamber 10, a main pump 20, an auxiliary pump 50, a roughing valve 80, a foreline valve 90, and a scrubber 70. As mentioned above, a deposition or etching process is carried out in the reaction chamber 10. The first pipe 30 is connected to main pump 20. The second pipe 40 is connected to reaction chamber 10. The roughing valve 80 and foreline valve 90 are disposed in-line with the second pipe 40 and the first pipe 30, respectively, to open and close the pipes. Main pump 20 is used to produce a high level of vacuum within the reaction chamber 10. Auxiliary pump 50 is used to produce a low level of vacuum within the reaction chamber 10 via the second pipe 40. The scrubber 70 collects and refines air or reaction gas discharged through a third pipe 60 connected to the auxiliary pump 50, and then discharges the refined air or reaction gas.

Reaction gases used in the manufacturing process are supplied into the reaction chamber 10 through an external reaction gas supply section (not shown). Also, plasma may be produced from the reaction gases to enhance the efficiency and uniformity of the process. To this end, various types of electrodes may be used to excite the reaction gases. Furthermore, a susceptor or an electrostatic chuck may be provided at a lower portion of the reaction chamber 10 to support the wafer. The apparatus may also employ sensors to detect various states of the process occurring in reaction chamber 10. Typically, these sensors are incorporated into a sidewall of the reaction chamber 10 or are disposed in upper and lower portions of the reaction chamber 10.

Also, a plurality of ports can be provided in the sidewall or in upper and lower walls of the reaction chamber 10. The ports define passages open to the inside of the reaction chamber 10. Preferably, the first and second pipes 30 and 40 are connected to the ports.

In one form of conventional semiconductor device manufacturing equipment, a plurality of the reaction chambers 10 are clustered and connected to each other. In this case, the second pipe 40 is connected to one of the reaction chambers 10 of the cluster. Moreover, the main pump 20 directly cooperates with a port in the reaction chamber 10, i.e., is not connected to the reaction chamber 10 using a separate pipe, to maximize the efficiency by which the reaction chamber 10 can be evacuated. In general, a high performance turbo pump is used as the main pump 20 to produce a high level of vacuum in the reaction chamber 10. Such a turbo pump is disclosed in U.S. Pat. No. 4,036,565.

During an etching or deposition process, the conventional turbo pump pumps air or reaction gas from the reaction chamber 10 using a high speed rotor. However, as wafers having larger and larger diameters are used to manufacture semiconductor devices, larger reaction chambers must be used to accommodate such wafers. Thus, it takes a longer time to get the rotor up to speed to produce the high level of vacuum required in the reaction chamber.

The conventional turbo pump has the following disadvantages.

First, the speed of the turbo pump rotor must be gradually reduced during preventive maintenance (PM) of the reaction chamber 10 when the reaction chamber 10 is opened. In this respect, the turbo pump is shut down and the rotor is allowed to slow down on its own. Accordingly, it takes a relatively longer amount of time to reduce the speed of the rotor, which time results in lost productivity.

Second, the foreline valve 90 must be closed, and the turbo pump rotor must be stopped when a wafer is unloaded from the reaction chamber 10. However, if there is a leak in the foreline valve 90, the rotor may contact an adjacent stator and break. This can allow air back into the reaction chamber, which may contaminate the wafer and thus lower the manufacturing yield.

SUMMARY OF INVENTION

An object of the present invention is to provide a turbo pump in which the rotor of the pump can be slowed down in a relatively short amount of time.

Likewise, an object of the present invention is to provide a processing apparatus including a reaction chamber, and a turbo pump communicating with the reaction chamber for evacuating the same, wherein a rotor of the pump can be slowed down in a relatively short amount of time thereby maximizing the productivity by which several courses of the process can be performed in the reaction chamber.

Still another object of the present invention is to provide a processing apparatus including a reaction chamber, and a turbo pump communicating with the reaction chamber for evacuating the same, wherein the blades of a rotor of the pump are protected from contacting the stator when, for example, air backflows into the housing through a discharge port of the housing.

According to one aspect of the present invention, a turbo pump has a housing, a plurality of fixed stator rings spaced from each other in a first direction along an inner peripheral surface of the housing, a shaft supported for rotation in the housing, a stator base surrounding the shaft and having an electric coil, a rotor including a rotor body secured to the shaft, and a plurality of rotor blades connected to the rotor body, and an electrode disposed at an outer wall surface of the housing. The rotor blades are each interposed between an adjacent pair of the stator rings. The electrode is disposed at a location corresponding to that of the rotor blades. Accordingly, an electrostatic force of attraction will stop the rotor from rotating when electric charges of opposite types are applied to the electrode and the blades of the rotor.

According to another aspect of the invention, apparatus for processing a substrate such as a semiconductor wafer includes a turbo pump in combination with a reaction chamber in which the substrate is processed, wherein the turbo pump includes a housing having a suction port communicating with the interior of the reaction chamber, and a discharge port, a plurality of fixed stator rings spaced from each other along an inner peripheral surface of the housing, a shaft supported for rotation within the housing, a stator base surrounding the shaft and having an electric coil, a rotor including a rotor body secured to the shaft and a plurality of rotor blades connected to the rotor body and each interposed between an adjacent pair of the stator rings, and an electrical contact electrically conductively connected to the rotor such that a charge can be applied to the rotor via the contact.

The apparatus also includes a pipe connected to the discharge port of the housing, and a valve is disposed in-line with the pipe. The valve is movable between respective positions at which the pipe is opened and closed. Thus, even when the valve leaks and allows air to backflow into the reaction chamber through the pipe, the same type of charges can be applied to the blades of the rotor (via the electrical contact) and to the stator (via the electric coil of the stator base) to prevent the blades of the rotor from contacting the stator.

According to still yet another aspect of the invention, the turbo pump also includes an armature disk to which the shaft is connected, and first and second magnets facing first and second surfaces of the armature disk, respectively. The polarity of the magnets are arranged to suspend the armature disk.

The shaft extends from one side of the armature disk, and a nut disposed at the other side of the armature disk secures the shaft to the disk. Preferably, the electrical contact is disposed on the nut so that the contact supplies current to the shaft via the nut. Also, sensors may be mounted to the nut to receive power via the electrical contact. For instance, a proximity sensor may be provided to sense the distance between one of the magnets and the armature disk. Also, a rotary speed sensor may be provided to sense the rotary speed of the shaft.

BRIEF DESCRIPTION OF THE DRAWINGS

The above and other aspects of the present invention will become more apparent to those of ordinary skill in the art form the following detailed description of the preferred embodiments thereof made with reference to the attached drawings in which.

DETAILED DESCRIPTION OF THE PREFERRED EMBODIMENTS

The present invention will now be described more fully hereinafter with reference to the FIGS. 2-4. Like numbers are used to designate like elements throughout the drawings.

Figure 1:
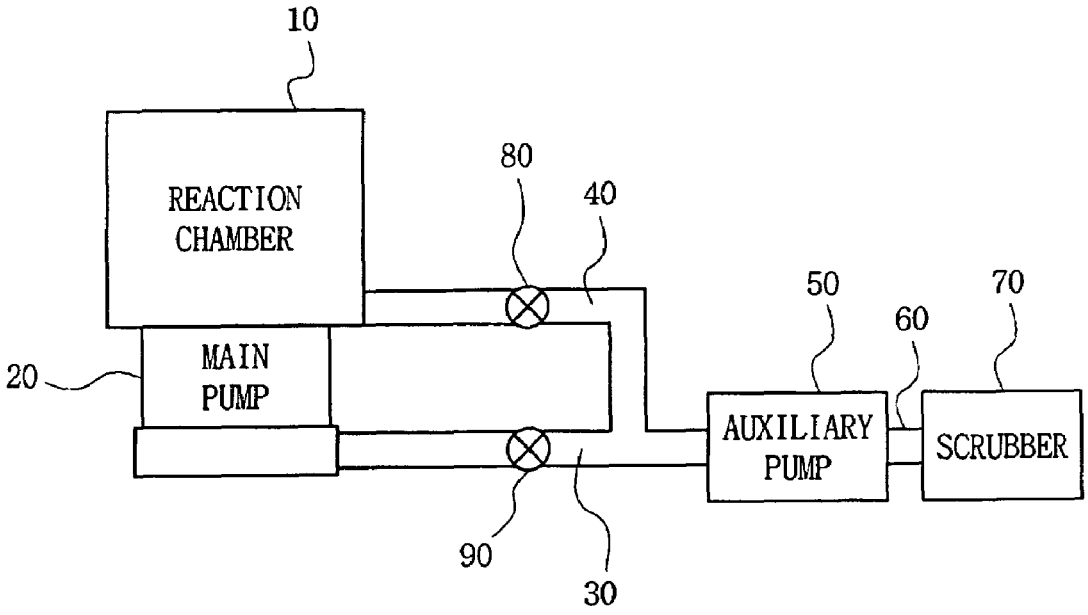
FIG. 1(PRIOR ART)
FIG. 1 is a schematic diagram of a conventional apparatus used to manufacture semiconductor devices.
Figure 2:
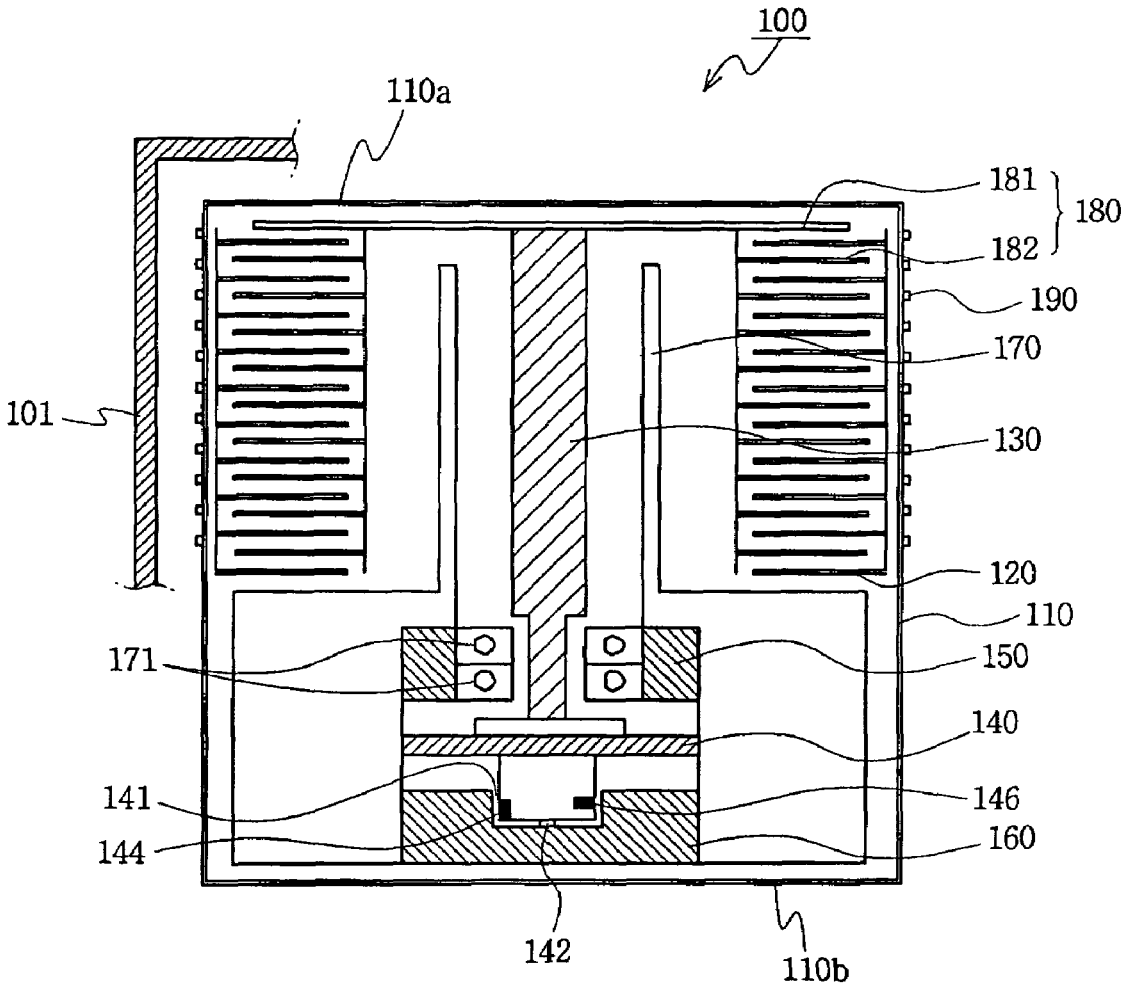
FIG. 2 is a longitudinal sectional view of a turbo pump according to the present invention.

As shown in FIG. 2, a turbo pump 100 includes a housing 110, a stator 120, a shaft 130, an armature disk 140, first and second magnets 150 and 160, a stator base 170, a rotor 180, and an electrode 190.

Housing 110 is preferably cylindrical and is disposed in a reaction chamber 100. The stator 120 has a plurality of fixed rings (annular blades) spaced apart from each other by a specific interval in a given direction along an inner peripheral surface of housing 110. The shaft 130 extends axially in the same given direction along a central portion of housing 110, and is supported for rotation in the housing.

In particular, the armature disk 140 is fixed to a lower portion of shaft 130. The first (upper) and second (lower) magnets 150 and 160 are disposed above and below the armature disk 140, respectively. Also, each of the first and second magnets 150 and 160 is an electromagnet. The polarities of the upper and lower magnets 150 and 160 are arranged so that the fields produced by the magnets 150 and 160 suspend the armature disk 140 to minimize friction when the shaft 130 rotates.

An upper portion of the stator base 170 surrounds the shaft 130. Also, the stator base 170 has an electric coil to induce an electromotive force that rotates shaft 130 at a high speed in a first direction. More specifically, the shaft 130 comprises at least one permanent magnet. The fields produced by the permanent magnet and by passing current through the coil of the stator base 170 cause the shaft 130 to rotate. That is, the shaft 130 is rotated in the same manner as the output shaft of a motor. In this respect, a single-phase voltage source or a three-phase voltage source may be connected to the electronic coil. Moreover, the shaft 130 is supported by bearings 171 because the shaft 130 rotates at a high speed. The bearings 171 are disposed inside of the first magnet 150 to facilitate a smooth rotation of the shaft 130. The first magnet 150, in turn, is disposed inside the stator base 170.

The rotor 180 is basically interposed between the stator base 170 and housing 110. The rotor 180 includes a rotor body 181 fixed to the top of the shaft 130, and a plurality of rotor blades 182 connected to the rotor body 181. The rotor body 181 surrounds the upper portion of the stator base 170. Each of the blades 182 of the rotor 180 rotates at a high speed between an adjacent pair of the fixed rings of the stator 120.

Accordingly, the rotor 180 is preferably of a light-weight metal such as aluminum. The blades 182 are disposed parallel to each other and perpendicular to the axis of rotation of the rotor, i.e., perpendicular to the central axis of the housing 110. On the other hand, the leading face of each of the blades 182 is skewed (inclined) relative to a plane extending perpendicular to the axis of rotation of the rotor 180. Also, the angles of inclination of the blades become larger from the suction port to the discharge port to cause a greater volume of air to be pumped at the discharge port side of the housing 110 than at the suction port side.

The electrode 190 is disposed along an outer peripheral surface of the housing 110 opposite the rotor 180. The electrode 190 receives an electric charge opposite to the electric charge applied to the rotor 180 to produce an electrostatic force that stops the rotation of the rotor 180.

The housing 110 includes a suction port 110*a* and a discharge port 110*b*. The suction port 110*a* is connected to a port of the reaction chamber 100. Gas or reaction gas induced through the suction port 110*a* is discharged through the discharge port 110*b*. The discharge port 110*b* is connected to pipe 30 in which valve 90 is disposed. The housing 110 is formed of an electrically insulative material such as plastic or Teflon® so as to be insulated from the external voltage impressed across the electrode 190 and from the electrostatic charge of the rotor 180. Also, a metal cover 101 (part of which is shown) may be provided over the entire surface of housing 110 to isolate electrode 190.

In addition, although the stator 120 is preferably formed of an electrical insulator, the stator 120 may alternatively be formed of a conductive material (metal). In this case, the stator 120 is charged similarly to the rotor 180 to prevent the stator 120 from contacting the rotor 180 while the rotor 180 is rotating.

The shaft 130 extends vertically at one side of the armature disk 140 and protrudes through the disk 140. A nut 141 is disposed at the other side of the armature disk 140 to secure the disk 140 to the shaft 130. An electrical contact 142, i.e., a terminal, is preferably formed at the center of nut 141. The contact conducts current from the lower magnet 160 or an outside voltage source to a proximity sensor 144 and a rotary speed sensor 146. The proximity sensor 144 is positioned to measure the distance between the armature disk 140 and the lower magnet 160. The rotary speed sensor 146 is installed at an edge of the nut 141 to detect the speed of the shaft 130 in revolutions per minute (rpms).

A controller receives signals output by the proximity sensor 144 and the rotary speed sensor 146 and which signals are thus indicative of the distance between the armature disk 140 and the lower magnet 160 and of the speed of the shaft 130. The controller then outputs electric control signals to the power sources that supply current to the lower magnet 60 and to the electric coil of the shaft 130 to rotate the shaft 130 at an optimal speed while maintaining a specific distance between the magnet 160 and the armature disk 140.

The body 181 and blades 182 of the rotor may be charged (positively or negatively) via nut 141 and shaft 130. Thus, when the rotor 180 is to be stopped, the electrode 190 is charged to create an electrostatic attraction between the electrode 190 and the rotor. For example, when the rotor 180 is positively charged, the controller causes the electrode 190 to be negatively charged which creates a force of attraction that stops the blades 182.

Figure 3A:
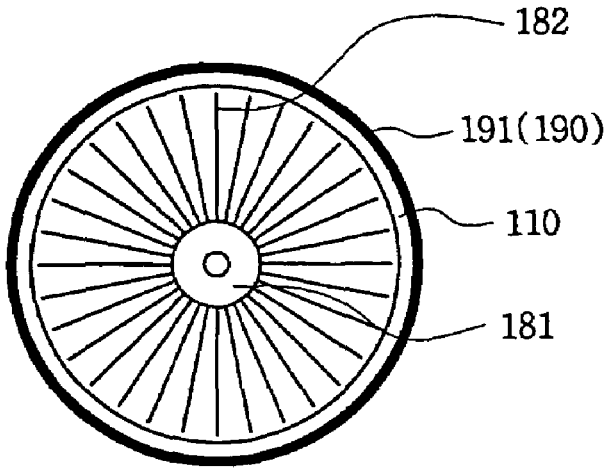
FIGS. 3A and 3B are plan views of two versions of the turbo pump shown in FIG. 2, respectively.
Figure 3B:
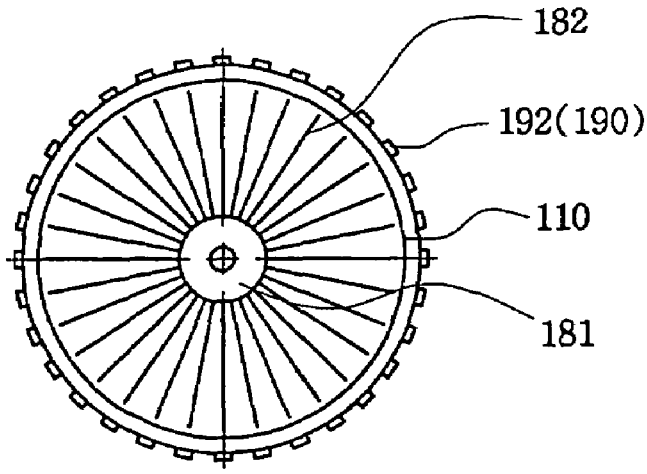

In addition, the electrode 190 may include a lead wire 191 extending along the outer wall surface of the housing 110, as shown in FIG. 3A, or a plurality of plates 192 as shown in FIG. 3B. The lead wire 191 comprises a plurality of windings extending around the housing 110 at locations corresponding to the rows of blades 182. Thus, the lead wire 191 can stop the blades 182 quickly. In contrast, the number and disposition of the plates 192 corresponds to the blades 182. Therefore, the plates 192 can stop the blades 182 at designated positions. However, a turbo pump having an electrode 190 comprising the plates 192 requires more time to stop the blades 182 because the plates 192 provide a smaller electrostatic force than the lead wire 191.

Figure 4:
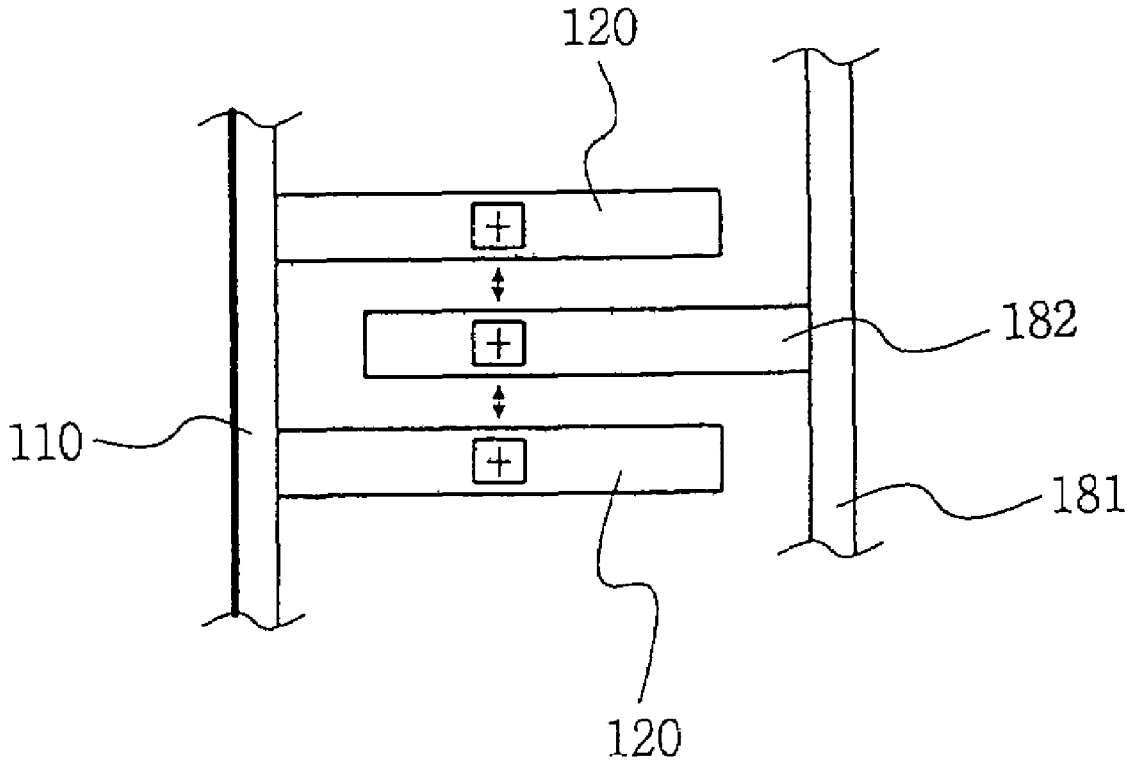
FIG. 4 is an enlarged sectional view of part of the stator and rotor of the turbo pump shown in FIG. 2.

FIG. 4 shows the effect of applying the same type of electric charge, e.g., positive charge, to the stator 120 and blades 182 to produce a force of repulsion. Accordingly, the bending of the blades 182, and contact between the blades 182 and the stator 120 can be prevented even when air flows back from the discharge port 110*b* to the suction port 110*a* as can occur when there is a leak in the foreline valve 90. Accordingly, the blades 182 are prevented from being damaged. Hence, a wafer in the reaction chamber 100 to which the turbo pump 100 is connected will not be contaminated. On the other hand, though, when an air pressure exceeding a predetermined pressure builds up on the side of the rotor 180 facing the stator 120, opposite charges can be applied to the blades 182 of the rotor 180 and the stator 120.

Finally, although the present invention has been described above in connection with the preferred embodiments thereof, the scope of the present invention is not so limited. On the contrary, various modifications and alternative forms of the preferred embodiments, as will be apparent to persons of ordinary skill in the art, are seen to be within the true spirit and scope of the present invention as defined by the appended claims.

What is claimed is:

1. A turbo pump, comprising:

a housing;

a plurality of fixed stator rings spaced from each other in a first direction along an inner peripheral surface of the housing;

a shaft extending longitudinally in said first direction in the housing, and supported for rotation in the housing;

a stator base surrounding the shaft, and having an electric coil;

a rotor including a rotor body secured to the shaft, and a set of rotor blades connected to the rotor body, respective ones of the rotor blades each being interposed between a respective pair of the stator rings adjacent one another in the first direction; and an electrode disposed at an outer wall surface of the housing at such a location that when electric charges of opposite types are applied to the electrode and the set of blades of the rotor, an electrostatic force of attraction between the electrode and the rotor will stop the rotor from rotating.

2. The turbo pump of claim 1, wherein the housing is of an electrically insulative material.

3. The turbo pump of claim 1, and further comprising a metallic cover surrounding the housing.

4. The turbo pump of claim 1, wherein the stator is of an electrically conductive material, such that charges of the same polarity can be applied to the stator and the rotor to prevent the stator rings from contacting the rotor blades while the rotor is rotating.

5. The turbo pump of claim 1, wherein the shaft comprises a permanent magnet.

6. The turbo pump of claim 1, and further comprising an armature disk to which the shaft is connected, and first and second magnets facing first and second surfaces of the armature disk, respectively, the polarity of the first and second magnets being arranged to suspend the armature disk.

7. The turbo pump of claim 6, wherein the shaft extends from one side of the armature disk, and further comprising a nut disposed at the other side of the armature disk and securing the shaft to the armature disk.

8. The turbo pump of claim 7, and further comprising an electrical contact disposed on the nut, wherein the contact supplies current to the shaft.

9. The turbo pump of claim 8, and further comprising a proximity sensor mounted to said nut and positioned to sense the distance between one of the magnets and the armature disk.

10. The turbo pump of claim 8, and further comprising a rotary speed sensor mounted to said nut and positioned to sense the rotary speed of the shaft.

11. The turbo pump of claim 1, and further comprising a plurality of bearings disposed inside the first magnet and supporting the shaft for rotation.

12. The turbo pump of claim 1, wherein the electrode is a lead wire extending around the housing.

13. The turbo pump of claim 1, wherein the electrode comprises a number of plates corresponding to the number of blades of the rotor.

14. Apparatus for processing a substrate, comprising:

a reaction chamber in which the substrate is processed;

a turbo pump including a housing having a suction port communicating with the interior of the reaction chamber, and a discharge port, a plurality of fixed stator rings spaced from each other in a first direction along an inner peripheral surface of the housing, a shaft extending longitudinally in said first direction in the housing and supported for rotation within the housing, a stator base surrounding the shaft, and having an electric coil, a rotor including a rotor body secured to the shaft, and a plurality of rotor blades connected to the rotor body, each of the rotor blades being interposed between an adjacent pair of the stator rings, an electrical conductor fixed relative to the rotor, an electrical contact extending from the rotor to the electrical conductor so as to electrically conductively connect the rotor and the electrical conductor such that a charge can be conducted from the electrical conductor to the rotor via the contact;

a pipe connected to the discharge port of the housing; and a valve disposed in-line with the pipe and movable between respective positions at which the pipe is opened and closed, wherein the turbo pump further comprises an armature disk to which the shaft is connected, and first and second magnets facing first and second surfaces of the armature disk, respectively, the polarity of the magnets being arranged to suspend the armature disk, and wherein the shaft extends from one side of the armature disk, and the turbo pump further comprises a nut disposed at the other side of the armature disk and securing the shaft to the disk, the electrical contact being disposed on the nut such that a charge can be applied to the shaft through the nut.

15. The apparatus of claim 14, wherein the turbo pump further comprises a proximity sensor mounted to said nut and positioned to sense the distance between one of the magnets and the armature disk.

16. The turbo pump of claim 14, wherein the turbo pump further comprises a rotary speed sensor mounted to said nut and positioned to sense the rotary speed of the shaft.

17. The apparatus of claim 14, wherein the stator of the turbo pump is of an electrically conductive material, such that charges of the same type can be applied to the stator and the rotor to prevent the stator rings from contacting the rotor blades while the rotor is rotating.

18. Apparatus for processing a substrate, comprising:

a reaction chamber in which the substrate is processed; and a turbo pump including a housing having a suction port communicating with the interior of the reaction chamber, and a discharge port, a plurality of fixed stator rings spaced from each other in a first direction along an inner peripheral surface of the housing, a shaft extending longitudinally in said first direction in the housing, and supported for rotation in the housing, a stator base surrounding the shaft, and having an electric coil, a rotor including a rotor body secured to the shaft, and a set of rotor blades connected to the rotor body, respective ones of the rotor blades each being interposed between a respective pair of the stator rings adjacent one another in the first direction, and an electrode disposed at an outer wall surface of the housing at such a location that when electric charges of opposite types are applied to the electrode and the set of blades of the rotor, an electrostatic force of attraction between the electrode and the rotor will stop the rotor from rotating.

19. The turbo pump of claim 1, wherein said electrode is juxtaposed in a radial direction, perpendicular to the axial direction, with the set of blades of the rotor.

20. The apparatus of claim 18, wherein said electrode is juxtaposed in a radial direction, perpendicular to the axial direction, with the set of blades of the rotor.

* * * * *